US008779990B2

(12) United States Patent
Odagiri

(10) Patent No.: US 8,779,990 B2
(45) Date of Patent: Jul. 15, 2014

(54) ANTENNA AND WIRELESS COMMUNICATION APPARATUS USING SAME

(75) Inventor: Kazuya Odagiri, Tokyo (JP)

(73) Assignees: Sony Corporation, Tokyo (JP); Sony Computer Entertainment Inc., Tokyo (JP)

( * ) Notice: Subject to any disclaimer, the term of this patent is extended or adjusted under 35 U.S.C. 154(b) by 462 days.

(21) Appl. No.: 12/295,871

(22) PCT Filed: Apr. 5, 2007

(86) PCT No.: PCT/JP2007/000370

§ 371 (c)(1), (2), (4) Date: Jan. 29, 2009

(87) PCT Pub. No.: WO2007/125643

PCT Pub. Date: Nov. 8, 2007

(65) Prior Publication Data

US 2010/0045539 A1 Feb. 25, 2010

(30) Foreign Application Priority Data

Apr. 5, 2006 (JP) ..... 2006-103881

(51) Int. Cl.

| | |
|---|---|
| ***H01Q 1/24*** | (2006.01) |
| ***H01Q 9/30*** | (2006.01) |
| ***H01Q 9/38*** | (2006.01) |
| ***H01Q 19/00*** | (2006.01) |
| ***H01Q 19/10*** | (2006.01) |
| ***H01Q 1/48*** | (2006.01) |
| ***H01Q 1/38*** | (2006.01) |

(52) U.S. Cl.

USPC ..... 343/702; 343/828; 343/829; 343/833; 343/834; 343/846; 343/700 MS

(58) Field of Classification Search

USPC ..... 343/702, 828, 829, 833, 834, 846, 343/700 MS

See application file for complete search history.

(56) References Cited

U.S. PATENT DOCUMENTS

| | | | |
|---|---|---|---|
| 7,512,413 | B2 | 3/2009 | Hui et al. |
| 2005/0041624 | A1 | 2/2005 | Hui et al. |
| 2006/0017621 | A1 | 1/2006 | Okawara et al. |

FOREIGN PATENT DOCUMENTS

| | | |
|---|---|---|
| EP | 1 359 639 | 11/2003 |
| EP | 1 475 858 | 11/2004 |

(Continued)

OTHER PUBLICATIONS

"Capacitors and Capacitance," John D. Kraus, Electromagnetics, Second Edition, McGraw Hill, 1973.*

(Continued)

*Primary Examiner* — Dameon E Levi
*Assistant Examiner* — Graham Smith
(74) *Attorney, Agent, or Firm* — Katten Muchin Rosenman LLP

(57) ABSTRACT

An antenna which is laid out efficiently while ensuring a predetermined antenna directivity. An antenna area is formed on a corner of a substrate. An antenna conductor is formed in the antenna area, and is shaped so that a bend is formed between its ground end and its open end. A first ground area is formed on the substrate near the ground end of the antenna conductor, and is connected to the ground end. A second ground area is formed on the substrate near the open end of the antenna conductor. A feed unit feeds electricity to the antenna conductor.

9 Claims, 7 Drawing Sheets

(56) References Cited

FOREIGN PATENT DOCUMENTS

| | | |
|---|---|---|
| JP | 2001-168629 | 6/2001 |
| JP | 2001-345745 | 12/2001 |
| JP | 2002-299933 | 10/2002 |
| JP | 2002-374115 | 12/2002 |
| JP | 2003-283225 | 10/2003 |
| JP | 2004-40596 | 2/2004 |
| JP | 2004-159287 | 6/2004 |
| JP | 2004-201278 | 7/2004 |
| JP | 2004-363848 | 12/2004 |
| JP | 2005-277448 | 10/2005 |
| WO | 2007/125643 | 11/2007 |

OTHER PUBLICATIONS

"Impedance and Admittance," J. David Irwin, Basic Engineering Circuit Analysis, 7th Ed., A Wiley First Edition, John Wiley and Sons, New York, 2002, pp. 273-274.*

J. David Irwin, Basic Engineering Circuit Analysis, 7th Ed., A Wiley First Edition, John Wiley and Sons, New York, 2002, pp. 260 and 439-440.*

"Antenna Theory: A Review," Balanis, Proc. IEEE, vol. 80, No. 1, Jan. 1992.*

Supplementary European Search Report dated Feb. 2, 2010, from the corresponding European Application.

International Search Report dated Jun. 26, 2007, from the corresponding International Application.

International Preliminary Report on Patentability dated Oct. 8, 2008, from the corresponding International Application.

International Preliminary Report on Patentability and Written Opinion of the International Searching Authority dated Nov. 17, 2008, from the corresponding International Application.

Written Opinion dated Sep. 21, 2008, from the corresponding Australian Application.

Notification of Reason(s) for Refusal dated Nov. 29, 2011, from corresponding Japanese Application No. 2006-103881.

Notification of Reason(s) for Refusal dated Feb. 14, 2012, from corresponding Japanese Application No. 2006-103881.

Chinese First Office Action dated Mar. 26, 2012, from corresponding Chinese Application No. 200780012447.9.

Malaysian Office Action dated Aug. 15, 2012, from corresponding Malaysian Application No. PI 20083949.

Notice of Preliminary Rejection dated Feb. 23, 2013, from corresponding Korean Application No. 10-2008-7027062.

Notification of Reason(s) for Rejection dated Oct. 11, 2013, from corresponding Taiwanese Application No. 96112350.

* cited by examiner

ANTENNA AND WIRELESS COMMUNICATION APPARATUS USING SAME

TECHNICAL FIELD

The present invention relates to an antenna, and more particularly to an antenna that is formed on a substrate, and a wireless communication apparatus using the same.

BACKGROUND TECHNOLOGY

In order to miniaturize an antenna, the volume of the antenna conductor is preferably made smaller. In order to reduce the volume of the antenna conductor, grounded antennas are typically used. Typical examples of antennas include an L-type antenna and an inverted F-type antenna. The L-type antenna has an antenna conductor which is bent in the middle to reduce the distance between the antenna conductor and the ground. The inverted F-type antenna has an antenna conductor which is grounded at one end.

DISCLOSURE OF THE INVENTION

Problems to Be Solved by the Invention

For example, when a game apparatus and a game controller perform wireless communications with each other, both the units are provided with an antenna. In particular, since the game controller size is small, miniaturization of the antenna to be mounted thereon is also required. Despite being small-sized, the game controller is also required to implement various functions, and it is therefore desirable to make effective use of any available space. Moreover, since the game controller is hand held, radiations toward the human body are shielded. It is therefore desirable to make effective use of the radiation power of the antenna.

The present invention has been developed in view of the foregoing circumstances, and a general purpose thereof is to provide a technology for efficient layout of an antenna while ensuring a desired antenna directivity.

Means for Solving the Problems

To solve the foregoing problems, an antenna according to an embodiment of the present invention includes: an antenna area which is formed on a corner of a substrate; an antenna conductor which is formed in the antenna area and is shaped so that its first conductor part and second conductor part are connected to each other via a bend; a first ground area which is formed next to the antenna area and is connected to an end of the first conductor part; a second ground area which is formed next to the antenna area and is spaced away from an end of the second conductor part in a direction from the bend to the end of the second conductor part; and a feed unit which feeds electricity to the antenna conductor.

According to this embodiment, a low-profile grounded antenna is provided on the corner of the substrate, and the second ground area is formed near the second conductor part. This configuration makes it possible to lay out the antenna efficiently and ensure a desired antenna directivity as well.

Another embodiment of the present invention is a wireless communication apparatus. This apparatus includes an antenna and a communication unit which performs wireless communication through the antenna. The antenna includes: an antenna area which is formed on a corner of a substrate; an antenna conductor which is formed in the antenna area and is shaped so that its first conductor part and second conductor part are connected to each other via a bend; a first ground area which is formed next to the antenna area and is connected to an end of the first conductor part; a second ground area which is formed next to the antenna area and is spaced away from an end of the second conductor part in a direction from the bend to the end of the second conductor part; and a feed unit which feeds electricity to the antenna conductor.

According to this embodiment, the wireless communication apparatus is provided with a low-profile grounded antenna which is arranged on the corner of the substrate, and the second ground area is formed near the second conductor part. This configuration makes it possible to lay out the antenna efficiently and ensure a desired antenna directivity as well.

Yet another embodiment of the present invention is also a wireless communication apparatus. This apparatus is a wireless communication apparatus having a grounded antenna. The grounded antenna includes: an antenna conductor whose open end is located in a position not covered by user's hands when the user performs ordinary operations; and a ground area which is formed near the open end of the antenna conductor.

According to this embodiment, the end of the antenna conductor is located in a position not covered by the user's hands. This can reduce the influence of the user's hands on the antenna directivity.

Effects of the Invention

According to the present invention, it can lay out the antenna efficiently and ensure a desired antenna directivity as well.

Figure 1A:
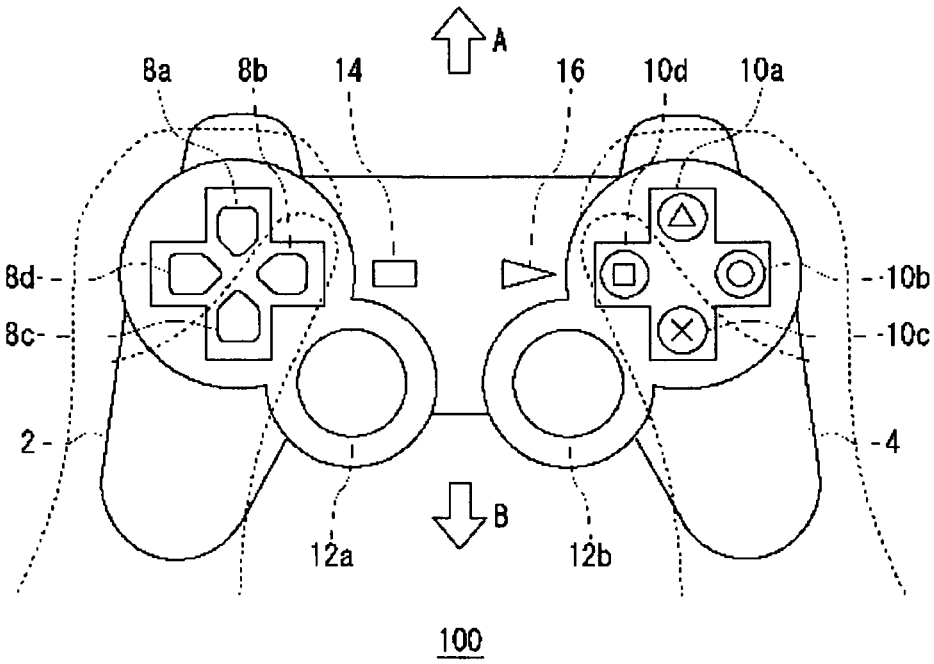
FIGS. 1A and 1B are diagrams showing the configuration of a game controller according to an embodiment of the present invention.

DESCRIPTION OF REFERENCE NUMERALS substrate 50, antenna area 52, ground area 54, antenna conductor 56, ground end 58, open end 60, bend 62, feed line 64, feed unit 66, first borderline 80, second borderline 82, game controller 100.

THE BEST MODE FOR CARRYING OUT THE INVENTION

An embodiment of the present invention relates to a game controller which is connected to a game apparatus by a wireless line. In particular, the embodiment relates to an antenna which is arranged inside the game controller. The game apparatus includes the functions of reproducing an optical disc, a recording medium on which a game program is recorded, and displaying game characters and background images on the screen of a television set according to the game program. The game controller accepts user operations, and controls the operation of the game apparatus, thereby running the game software recorded on the optical disc. The antenna to be provided in such a game controller requires miniaturization. For effective use of the space inside the game controller, the antenna also requires an efficient layout. Moreover, since the game controller is supposed to be hand held, the human body is naturally located behind the game controller. The directivity is thus desirably lowered in that direction and enhanced in the forward direction, away from the user's body. Under the circumstances, an antenna according to the present embodiment is configured as described below.

Figure 1B:
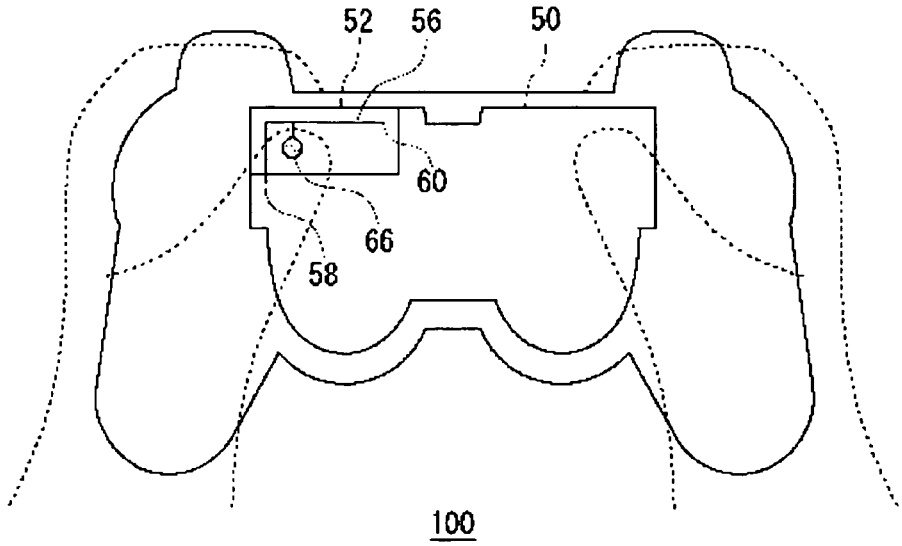

FIGS. 1A and 1B show the configuration of a game controller 100 according to the embodiment of the present invention. FIG. 1A is a top view showing the appearance of the game controller 100. The game controller 100 includes a first grip 2, a second grip 4, a first direction button 8*a*, a second direction button 8*b*, a third direction button 8*c*, a fourth direction button 8*d*, a first instruction button 10*a*, a second instruction button 10*b*, a third instruction button 10*c*, a fourth instruction button 10*d*, a first rotational operator 12*a*, a second rotational operator 12*b*, a select switch 14, and a start switch 16. The first to fourth direction buttons 8*a* to 8*d* will be collectively referred to as direction buttons 8. The first to fourth instruction buttons 10*a* to 10*d* will be collectively referred to as instruction buttons 10. The first and second rotational operators 12*a* and 12*b* will be collectively referred to as rotational operators 12.

The direction buttons 8 protrude from the top of the game controller 100 and are arranged orthogonal to each other. Moreover, the four direction buttons 8 are integrally connected to each other. For example, the direction buttons 8 function as a directional instruction control unit for controlling the movement of a display character. Pressing the first to fourth direction buttons 8*a* to 8*d* moves the display character in the arranging directions of the direction buttons 8 pressed.

The instruction buttons 10 are also arranged orthogonal to each other. The first to fourth instruction buttons 10*a* to 10*d* are formed as separate respective members. The instruction buttons 10 are provided with corresponding switch elements which serve as signal input devices. For example, when the first to fourth instruction buttons 10*a* to 10*d* are pressed to turn on the corresponding switches, various functions of the display character assigned to the respective instruction buttons 10 are performed.

The rotational operators 12 are arranged in opposing positions at the base-side corners of the first grip 2 and the second grip 4. The rotational operators 12 are rotatable 360° about their spindles, and are operated to activate signal input devices such as variable resistive elements. More specifically, the rotational operators 12 are attached to the extremities of spindles which are mounted so as to return to their neutral positions by means of a urging member, and are rotationally operated 360° about the rotating centers of the spindles. The rotational operators 12 can be rotated to achieve analog motions such as moving a display character with rotation, moving it with a change in speed, and changing the shape of the character.

The start switch 16 is positioned between the direction buttons 8 and the instruction buttons 10, and is intended to initiate a game. The select switch 14 is used to make a selection such as a game level, for example, when starting the game.

Holding the first grip 2 and the second grip 4 in the palms of both hands eliminates the need to support the game controller 100 with thumbs and fingers. That is, the game controller 100 can be held so that a maximum of two thumbs and eight fingers of the hands, or at least two thumbs and four fingers, are freely movable. In FIG. 1A, the human hands holding the game controller 100 are shown by the broken lines. For example, when the first grip 2 and the second grip 4 are held in the palms of both hands, the first rotational operator 12*a*, the second rotational operator 12*b*, the direction buttons 8, and the instruction buttons 10 can be operated with the thumbs of both the right and left hands.

These rotational operators 12, direction buttons 8, and instruction buttons 10 can be pressed selectively. In particular, the rotational operators 12 are arranged in opposite positions on the base-sides of the first and second grips 2 and 4 which are held in the palms of the hands. The rotational operators 12 are thus positioned closest to the thumbs of the right and left hands when the first grip 2 and the second grip 4 are held by the hands. This facilitates rotating the rotational operators 12 with the thumbs of the right and left hands.

It should be appreciated that the body of the person who operates the game controller 100 is located behind the game controller 100 shown in FIG. 1A, and a game apparatus is located in front. For the sake of convenience, the direction shown by the arrow A in FIG. 1A will hereinafter be referred to as "forward" or "front," and the direction shown by the arrow B as "backward" or "rear."

FIG. 1B shows the internal configuration of the game controller 100 shown in FIG. 1A. In this instance, components pertaining to the antenna according to the embodiment of the present invention will in particular be shown. The game controller 100 includes a substrate 50. The substrate 50 includes an antenna area 52, an antenna conductor 56, and a feed unit 66. As shown in the diagram, the antenna area 52 is formed on a front corner of the substrate 50. Since the antenna area 52 is formed on the corner of the substrate 50, part of the two edges of the substrate 50 constitute two sides of the antenna area 52, respectively. The substrate 50 is also used as a ground area, so that the ground area, the antenna conductor 56, and an open end 60 constitute a grounded antenna. As mentioned previously, the game apparatus typically lies in front of the user. The antenna area 52 is thus preferably arranged in the front part of the substrate 50 for the sake of effective radiation of waves in a forward direction.

As shown in FIGS. 1A and 1B, while the game controller 100 is operated, the first grip 2 and the second grip 4 are held by the hands. In this instance, the thumb of the left hand is put in a position capable of pressing the direction buttons 8, and the thumb of the right hand is put in a position capable of pressing the instruction buttons 10. Such hand positions for ordinary user operations are shown by the broken lines in FIG. 1B. The first grip 2 and the direction buttons 8 shown in FIG. 1A are positioned near the antenna area 52, and thus the left hand adjoins the antenna area 52. This makes the directivity of the antenna formed in the antenna area 52 susceptible to influence by the human hand.

As shown in FIG. 1B, a ground end 58, the feed unit 66, and at least part of the antenna conductor 56 are covered by the user's hand. Meanwhile, the open end 60 is located in a position not covered by the user's hand when the user performs ordinary operations. Furthermore, the open end 60 adjoins the ground area of the substrate 50. As will be detailed later, such an arrangement reduces the influence of the human hand on the antenna directivity. The foregoing arrangement can also increase the size of the continuous areas of the substrate 50 other than the antenna area 52. This improves the degree of freedom in mounting electronic components and the like inside the game controller 100.

Figure 2:
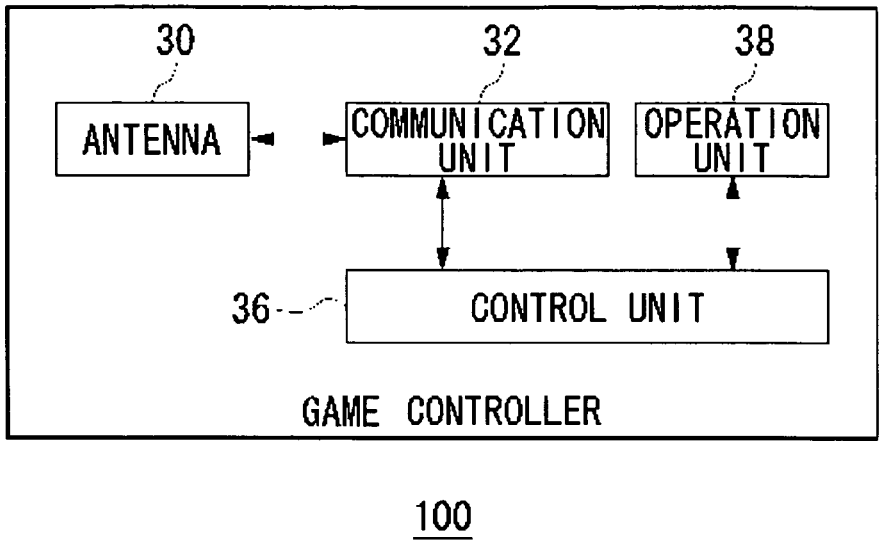
FIG. 2 is a diagram showing functional blocks of the game controller of FIGS. 1A and 1B.

FIG. 2 shows functional blocks of the game controller 100. The game controller 100 includes an antenna 30, a communication unit 32, a control unit 36, and an operation unit 38. The antenna 30 is composed of the antenna area 52, not-shown antenna conductors and the like shown in FIG. 1B. The antenna 30 has the function of transmitting and receiving signals of predetermined radio frequencies. In this instance, the radio frequency signals are transmitted to and received from the not-shown game apparatus. The configuration of the antenna 30 will be described later, and is thus omitted here.

The communication unit 32 performs wireless communication through the antenna 30. That is, the communication unit 32 performs encoding, modulation, and frequency conversion as transmission functions, and performs frequency conversion, demodulation, and decoding as reception functions. The communication functions of the communication unit 32 correspond to those of the not-shown game apparatus. Since the communication unit 32 is formed in the game controller 100, it transmits and receives information pertaining to game operations.

The operation unit 38 accepts information pertaining to game operations. The operation unit 38 corresponds to the direction buttons 8, the instruction buttons 10, the rotational operators 12, the select switch 14, and the start switch 16 of FIG. 1A, and accepts instructions for moving display characters and applying predetermined functions. The operation unit 38 outputs the accepted instructions to the control unit 36. The control unit 36 outputs the instructions accepted by the operation unit 38 to the communication unit 32. The control unit 36 outputs information received from the communication unit 32 to the operation unit 38.

In terms of hardware, the foregoing configuration can be achieved by an arbitrary computer CPU, a memory, and other LSIs. In terms of software, it can be achieved by a program which is loaded in a memory. The functional blocks shown here are practiced by the cooperation of such. It will thus be understood by those skilled in the art that these functional blocks may be practiced in various forms including hardware alone, software alone, or by using a combination thereof.

Figure 3:
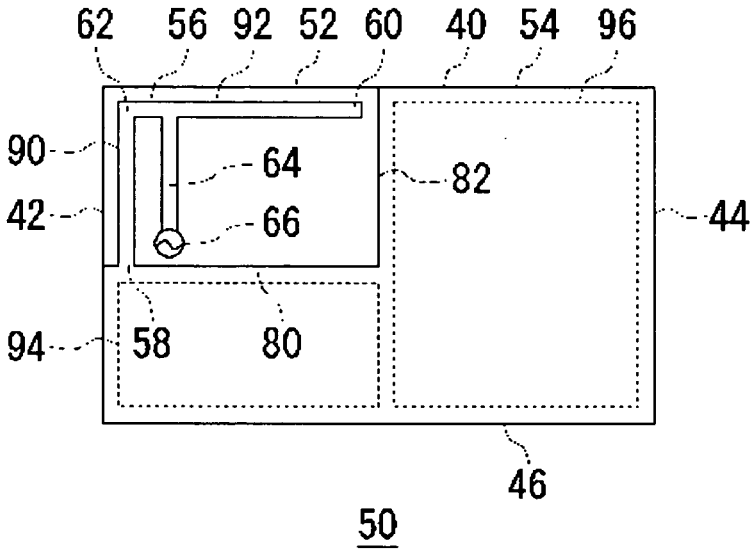
FIG. 3 is a diagram showing the configuration of the substrate of FIG. 1B.

FIG. 3 shows the configuration of the substrate 50. The substrate 50 includes the antenna area 52, a ground area 54, the antenna conductor 56, a feed line 64, and the feed unit 66. The ground area 54 includes a first ground area 94 and a second ground area 96. It should be appreciated that the substrate 50 shown in FIG. 3 corresponds to the substrate 50 shown in FIG. 1B or part of it. In this instance, for ease of description, the substrate 50 shall have the shape of a rectangle that is defined by four edges consisting of a front edge 40, a left side edge 42, a right side edge 44, and a rear edge 46.

The antenna area 52 is positioned in the front left area of the substrate 50. The antenna area 52 is formed next to the ground area 54. The antenna area 52 also has a rectangular shape, and the border between the antenna area 52 and the ground area 54 is shown by a first borderline 80 and a second borderline 82 which are orthogonal to each other, as shown in FIG. 3. Aside from the first borderline 80 and the second borderline 82, the antenna area 52 is also defined by part of the front edge 40 and part of the left side edge 42.

The antenna conductor 56 is formed in the antenna area 52 on the substrate 50. The antenna conductor 56 has a shape such that a bend 62 is formed between the ground end 58 and the open end 60, i.e., an "L" shape is formed. In this instance, the antenna conductor 56 shall be bent into a right angle at the bend 62. For ease of description, the part of the antenna conductor 56 extending from the ground end 58 to the bend 62 will be referred to as a first conductor part 90. The part extending from the bend 62 to the open end 60 will be referred to as a second conductor part 92.

The shape of the antenna conductor 56 is equivalent to that of the first conductor part 90 and the second conductor part 92 which are orthogonally connected to each other at the bend 62. The ground end 58 is connected to the first ground area 94 while the open end 60 is positioned near the second borderline 82. That is, the open end 60 is positioned closer to the center of the substrate 50 than the bend 62 is, when viewed from the left side edge 42. In this instance, the center of the substrate 50 shall refer to the midpoint between the left side edge 42 and the right side edge 44. In the foregoing configuration, the first conductor part 90 is arranged in parallel with the second borderline 82 and the left side edge 42. The second conductor part 92 is arranged in parallel with the first borderline 80 and the front edge 40.

The ground area 54 is formed on the substrate 50, and is composed of the first ground area 94 and the second ground area 96 as shown in the diagram. For ease of description, the ground area 54 shall be formed as a continuous area on the substrate 50, occupying the entire area of the substrate 50 other than the antenna area 52. The first ground area 94 is formed to adjoin and lie behind the antenna area 52. The border between the first ground area 94 and the antenna area 52 corresponds to the first borderline 80. The first ground area 94 is connected to the ground end 58. Meanwhile, the second ground area 96 is formed to adjoin the antenna area 52 so as to cover the right side of same. More specifically, the second ground area 96 is spaced away from the open end 60 of the second conductor part 92 in the direction from the bend 62 to the open end 60. The second ground area 96 is formed along the front edge 40 of the substrate 50. When viewed in the direction from the front edge 40 to the rear edge 46, the second ground area 96 has only to have a length at least capable of mirroring the forefront conductor out of the conductors formed in the antenna area 52. In this instance, the foremost conductor corresponds to the second conductor part 92. The border between part of the second ground area 96 and the antenna area 52 corresponds to the second borderline 82.

The feed unit 66 feeds electricity to the antenna conductor 56 through the feed line 64. The feed line 64 is formed in parallel with the first conductor part 90 of the antenna conductor 56, and is connected to the second conductor part 92 of same.

In the foregoing configuration, the antenna conductor 56 and the feed line 64 are arranged in an "inverted F" shape. These conductors and the first ground area 94 thus constitute an inverted F-type grounded antenna. It should be appreciated that the inverted F-type grounded antenna provides a higher field intensity at the open end 60 than at the bend 62. In this instance, the bend 62 of relatively low field intensity is arranged on the left side in the antenna area 52, i.e., near the left side edge 42. Meanwhile, the open end 60 of relatively high field intensity is arranged on the right side in the antenna area 52, i.e., near the second borderline 82. This can situate the open end 60 in a position not covered by the left hand. Consequently, it is possible to create a high field intensity in the center area of the substrate, thereby reducing the shielding effect of human hands and maintaining the forward directivity of the antenna.

In addition to this, an image of the inverted F-type grounded antenna is formed in the second ground area 96. The right ground area thus provides the antenna directivity of the image. The antenna directivity from the inverted F-type grounded antenna and the antenna directivity from the image are also superimposed on each other to enhance forward directivity. In the foregoing configuration, the second conductor part 92 of the antenna conductor 56 is designed to have a length approximately λ/4. In this instance, λ represents the wavelength of the radio waves in use. The lateral length of the second ground area 96, i.e., the distance from the right end of the ground area 54 to the second borderline 82 is at least approximately λ/4. Consequently, only the length of the substrate 50 from the left side edge 42 to the right side edge 44 has to be at least approximately λ/2, which allows miniaturization of the substrate 50.

Figure 4A:
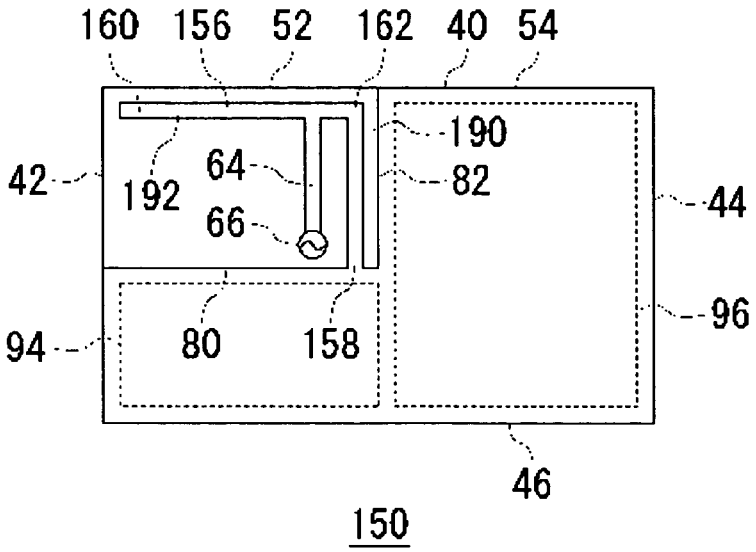
FIGS. 4A and 4B are diagrams showing the configurations of other substrates for comparison with the antenna characteristics of FIG. 1B.
Figure 4B:
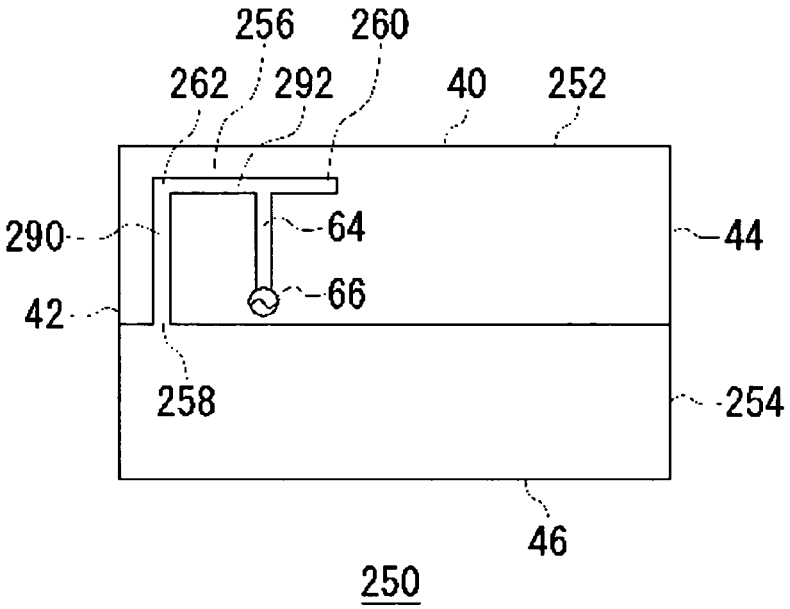

FIGS. 4A and 4B show the configurations of different substrates to be compared with the substrate 50 of FIG. 3, illustrating various antenna characteristics. The substrate 150 shown in FIG. 4A includes an antenna area 52 and a ground area 54. The antenna area 52 includes an antenna conductor 156. The antenna conductor 156 is shaped so that a first conductor part 190 and a second conductor part 192 are orthogonally connected to each other at a bend 162. The first conductor part 190 is arranged near the second borderline 82, in parallel with the second borderline 82 and the left side edge 42. The second conductor part 192 is arranged near the front edge 40, in parallel with the first borderline 80 and the front edge 40. A ground end 158 of the first conductor part 190 is connected to the first ground area 94. An open end 160 of the second conductor part 192 is positioned near the open left side edge 42. As shown in FIG. 4A, the antenna conductor 156, a feed line 64, a feed unit 66, and the first ground area 94 also constitute an inverted F-type grounded antenna on the substrate 150.

As described previously, the inverted F-type grounded antenna provides a higher field intensity at the open end 160 than at the bend 162. In this instance, the open end 160 of FIG. 4A is positioned farther from the second ground area 96 than the open end 60 of FIG. 3 is. That is, it is preferable to design the antenna configuration as shown in FIG. 4A.

The substrate 250 shown in FIG. 4B includes an antenna area 252 and a ground area 254. The antenna area 252 includes an antenna conductor 256. The antenna conductor 256 is composed of a first conductor part 290, a second conductor part 292, a ground end 258, an open end 260, and a bend 262, which correspond to the first conductor part 90, the second conductor part 92, the ground end 58, the open end 60, and the bend 62 of the antenna conductor 56 shown in FIG. 3, respectively. The antenna area 252 is formed in the front part of the substrate 250, and a ground area 254 is formed in the rear part of the substrate 250. The antenna conductor 256 and the ground area 254 constitute an inverted F-type grounded antenna, whereas the ground area 254 is not formed near the open end 260. This precludes the uniform formation of an image in the forward direction.

Figure 5A:
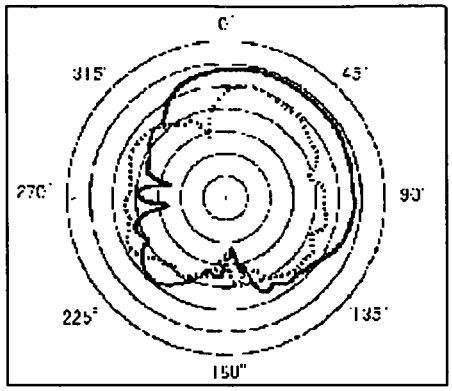
FIGS. 5A to 5C are diagrams showing the antenna characteristics according to the configuration of FIG. 3 and the antenna characteristics for comparison.
Figure 5B:
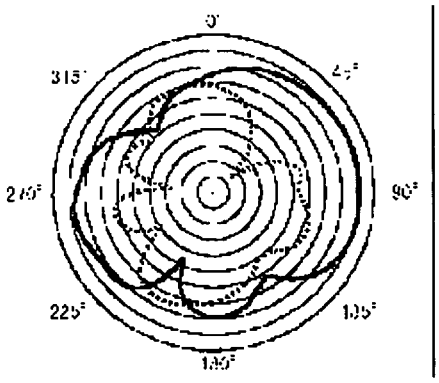
Figure 5C:
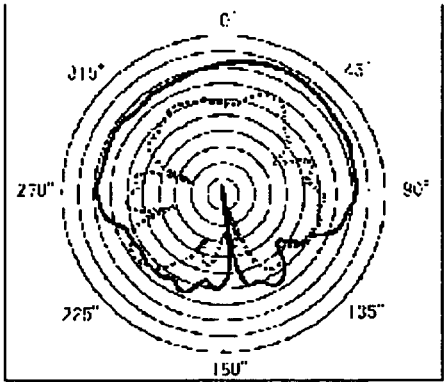

FIGS. 5A to 5C show antenna characteristics according to the configurations shown in FIG. 3 and FIGS. 4A and 4B when the game controller 100 is held in human hands. FIG. 5A shows the antenna characteristics according to the configuration of FIG. 4A. In this instance, the antenna characteristics are equivalent to antenna directivities, showing the antenna gains for respective directions. The top of FIG. 5A, i.e., the 0° direction corresponds to the forward direction of the substrate 150. The solid line shows the horizontal polarization characteristic, and the dotted line shows the vertical polarization characteristic. Since the game apparatus is provided with a horizontal polarization antenna, the following description will deal mainly with the horizontal polarization characteristic. In this instance, the open end 160 of FIG. 4A shall be covered by a human hand. The antenna gain in the left area is thus generally attenuated more than in the right area due to the influence of the human hand.

FIG. 5B shows the antenna characteristics according to the configuration of FIG. 4B. As compared to the antenna characteristics shown in FIG. 5A, the antenna characte gain improves because the open end 260 ristics shown in FIG. 5B provide higher antenna gains in the left area. The is located in the position not covered by human hands. Nevertheless, the antenna gain is attenuated in the vicinity of "315°" as compared to in the other areas.

FIG. 5C shows the antenna characteristics according to the configuration of FIG. 3. The conditions are the same as when the antenna characteristics shown in FIGS. 5A and 5B are acquired. As compared to the antenna characteristics shown in FIG. 5B, the antenna characteristics shown in FIG. 5C provide high antenna gains even in the vicinity of "315°." With the antenna characteristics shown in FIG. 5C, the image formed in the second ground area 96 can enhance the forward directivity and increase the forward antenna gains overall.

Figure 6:
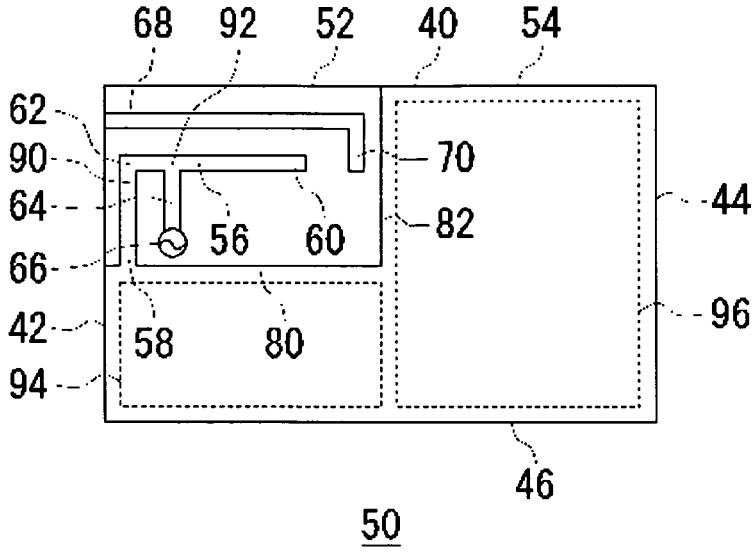
FIG. 6 is a diagram showing another configuration of the substrate of FIG. 1B.

FIG. 6 shows another configuration of the substrate 50. The substrate 50 of FIG. 6 includes a director 68 in addition to the configuration shown in FIG. 3. The director 68 is formed in the antenna area 52. The director 68 is positioned closer to an open edge of the substrate 50, i.e., closer to the front edge 40 than the second conductor part 92 of the antenna conductor 56 is. As shown in the diagram, the director 68 is placed in front of the antenna conductor 56.

The director 68 is arranged generally in parallel with the second conductor part 92 of the antenna conductor 56. In this instance, "generally in parallel" refers to situations where most of the director 68 is roughly in parallel, however it should be appreciated that complete parallelism is not required. The director 68 functions to direct the antenna pattern formed by the foregoing inverted F-type grounded antenna further forward. Furthermore, since the second ground area 96 lies in the longitudinal direction of the director 68, an image of the director 68 can be formed in the second ground area 96.

Consequently, even if the director 68 length is small, the image length can be added to make the director 68 substantially longer. As a result, it is possible to direct the antenna pattern further forward. It should be appreciated that while the second ground area 96 in FIG. 6 is shown as occupying the same area as the second ground area 96 does in FIG. 3, it may be formed only in a position at least capable of mirroring the director 68. That is, the second ground area 96 has only to have an area necessary for forming the image of the director 68. Such a configuration will be described later. The second ground area 96 can be narrowed to utilize the rest of the areas of the substrate 50 for mounting predetermined components.

Part of the director 68 lying close to the open end 60, i.e., the part close to the second borderline 82 makes a capacitor part 70. In this instance, the capacitor part 70 is bent generally in parallel with the second borderline 82. That is, the director 68 has an "L" shape. The capacitor part 70 of the director 68 forms a capacitor with the opposing second ground area 96, i.e., the area in the vicinity of the second borderline 82. This capacitor makes it possible to reduce the length of the wave director or the length of the second ground area 96.

A resonance frequency F0 is given by the following equation:

$$F0=1/(2\pi\sqrt{(L1+L2)C}),$$

where L1 is the inductance of the director 68, L2 is the inductance of a part corresponding to the image of the director 68 in the second ground area 96, and C is the capacitance of the capacitor.

Therefore, even if L1 and L2 are reduced, it is possible to maintain the value of FO by adjusting C. Consequently, the antenna pattern can be directed forward even when the length of the substrate 50 shown in FIG. 6, from the left end to the right end thereof, is made smaller than that of the substrate 50 shown in FIG. 3. For example, the length of the part extending from the right end of the ground area 54 to the second borderline 82 can be made smaller than λ/4. As a result, the width of the substrate 50 from the left side edge 42 to the right side edge 44 can be made smaller than λ/2, which allows further miniaturization of the substrate 50.

Figure 7:
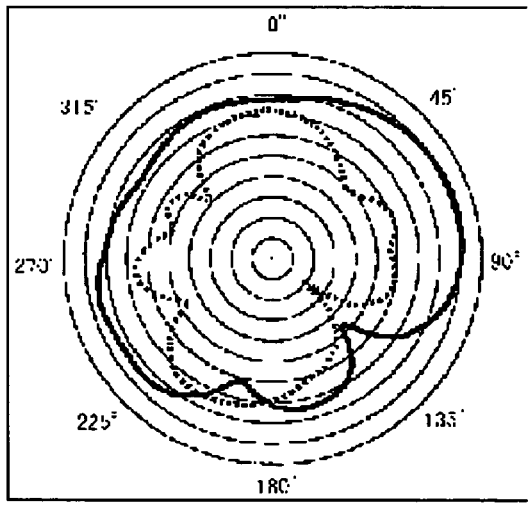
FIG. 7 is a diagram showing the antenna characteristics according to the configuration of FIG. 6.

FIG. 7 shows the antenna characteristics according to the configuration shown in FIG. 6. FIG. 7 is plotted in the same manner as FIGS. 5A to 5C are. A comparison between the antenna characteristics shown in FIG. 7 and that shown in FIG. 5C shows that the provision of the director 68 in the antenna area 52 as shown in FIG. 6 allows miniaturization of the antenna while achieving antenna characteristics equivalent to those according to the configuration of FIG. 3.

Figure 8A:
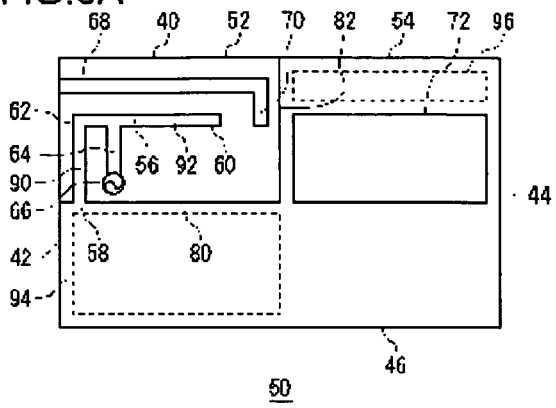
FIGS. 8A to 8E are diagrams showing yet other configurations of the substrate of FIG. 1B.

FIGS. 8A to 8E show further configurations of the substrate 50. The antenna area 52 of the substrate 50 shown in FIG. 8A is formed in the front left part of the substrate 50 as is the case with the substrate 50 shown in FIG. 6. As previously described, the second ground area 96 is arranged in a position capable of forming an image of the director 68. More specifically, the second ground area 96 is formed in the front right part of the substrate 50. When viewed in the direction from the front edge 40 to the rear edge 46, the second ground area 96 has a length smaller than that of the antenna area 52 and that of the second ground area 96 shown in FIG. 3. Therefore, a component mounting area 72 may be formed behind the second ground area 96. Components having predetermined functions are mounted on the component mounting area 72. Since the component mounting area 72 is thus formed on the substrate 50 aside from the antenna area 52 and the ground area 54, it is possible to miniaturize the apparatus. The ground area 54 is formed as a continuous area consisting of the first ground area 94 and the second ground area 96.

Figure 8D:
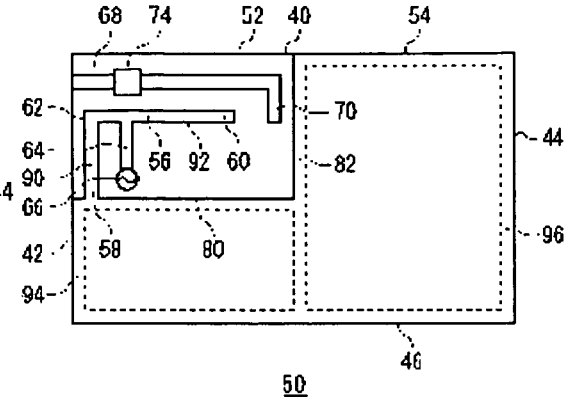
Figure 8B:
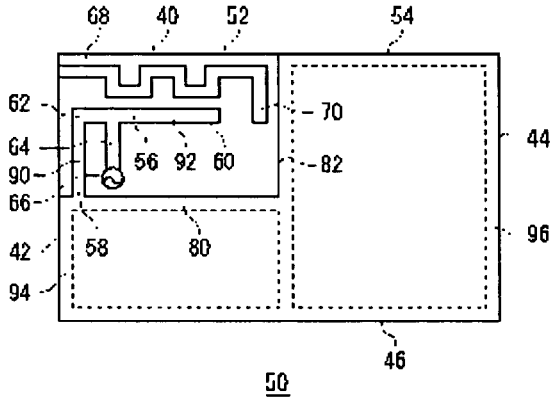
Figure 8E:
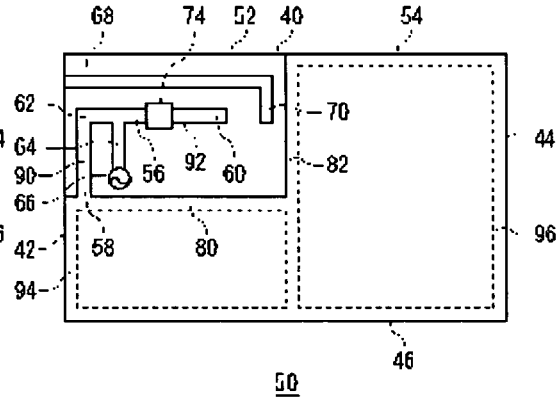
Figure 8C:
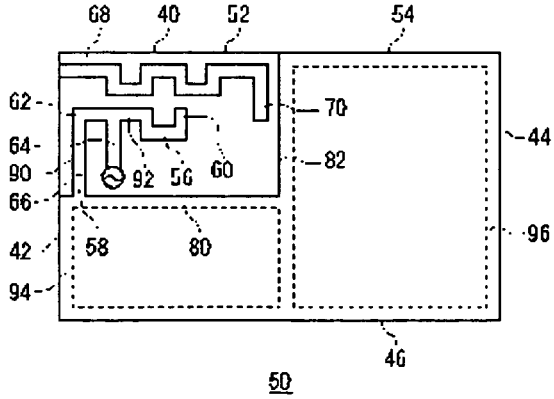

The substrate 50 shown in FIG. 8B has the same configuration as that of the substrate 50 shown in FIG. 6. In this instance, the director 68 is formed in a meandering shape. The director 68 of FIG. 8B thus has a substantially larger electrical length than when the director 68 is formed in a straight shape, as long as the linear distance from the left side edge 42 of the director 68 to the second borderline 82 is the same. Consequently, even if the part of the director 68 extending from the left end of the antenna area 52 to the capacitor part 70 has a linear length smaller than that of the director 68 of FIG. 6, it is possible to provide the same antenna characteristics as provided by the configuration shown in FIG. 6. In the substrate 50 shown in FIG. 8C, the second conductor part 92 of the antenna conductor 56 is also formed in a meandering shape while the rest of the configuration of FIG. 8B remains the same. Consequently, the antenna conductor 56 of FIG. 8C has a substantially larger electrical length than when the second conductor part 92 is formed in a straight shape, as long as the linear distance between the sides of the second conductor part 92 is the same.

The substrate 50 shown in FIG. 8D has the same configuration as that of the substrate 50 shown in FIG. 6. In this instance, the director 68 is provided with an additional chip coil 74. Since the inductance of the chip coil 74 is added to the inductance of the director 68, it is possible to reduce the length of the director 68 for the same resonance frequency. This allows miniaturization of the substrate 50. The substrate 50 shown in FIG. 8E has a chip coil 74 which is added to the second conductor part 92 of the antenna conductor 56. Consequently, the antenna conductor 56 can be reduced in length if the resonance frequency is the same. It should be appreciated that combinations of the configurations shown in FIGS. 8A to 8E also constitute applicable embodiments of the present invention. For example, the component mounting area 72 shown in FIG. 8A may be formed in the configurations shown in FIGS. 8B to 8E. The meandering configuration and the chip coil 74 shown in FIGS. 8B to 8E may be combined arbitrarily.

According to the embodiment of the present invention, the open end of the antenna conductor is located in a position not covered by the hands. This can prevent the antenna gain from dropping due to shielding by the hands. Since the open end of the antenna conductor is not directed toward any edges of the substrate, it is possible to reduce the effect of foreign factors on the antenna characteristics. Moreover, since the open end of the antenna conductor is directed toward the ground area, the antenna directivity can be directed forward because of superimposition of the image with the ground area. The use of the image superimposition also allows a reduction in the length of the antenna conductor. The reduced length of the antenna conductor also makes it possible to miniaturize the antenna. The use of the wave director and its image also makes it possible to direct the antenna directivity forward and miniaturize the substrate as well. Moreover, since the wave director is bent at the position near the ground area, a capacitor can be formed between the wave director and the ground area.

The formation of the capacitor allows reduction in the lengths of the wave director and the ground area. The reduced length of the wave director and the ground area also makes it possible to miniaturize the antenna. Furthermore, the formation of the component mounting area inside the ground area allows miniaturization of the entire apparatus. When either one or both of the antenna conductor and the wave director are formed in a meandering shape, it is possible to reduce the length of either one or both of the antenna conductor and the wave director. When either one or both of the antenna conductor and the wave director are provided with a chip coil, it is possible to reduce the length of either one or both of the antenna conductor and the wave director.

Up to this point, the present invention has been described in conjunction with the embodiment thereof. It should be appreciated that these embodiments are provided solely by way of illustration only. It will be understood by those skilled in the art that various modifications may be made to combinations of the foregoing components and processes, and all such modifications are also intended to fall within the scope of the present invention.

The embodiments have dealt with the case where the antenna area 52 is formed in the left part of the substrate 50. This is not restrictive, however. The antenna area 52 may be formed in the right part of the substrate 50 also. In that case, the components shown in the embodiments shall be arranged in a horizontally symmetrical pattern. According to this modification, it is possible to improve the degree of freedom in antenna design. In essence, only the antenna area 52 has to be formed on a corner of the substrate 50.

The embodiments have dealt with the case where the antenna conductor 56, the feed line 64, the feed unit 66, and the first ground area 94 form the inverted F-type grounded antenna. This is not restrictive, however. An inverted L grounded antenna may be formed with the antenna conductor 56, the feed unit 66, and the first ground area 94. In that case, the feed unit 66 is connected to the ground end 58 of the antenna conductor 56. According to this modification, it is possible to improve the degree of freedom in antenna design. In essence, only a low-profile grounded antenna has to be used.

The embodiments have dealt with the case where the first borderline 80 and the second borderline 82 are orthogonal to each other. This is not restrictive, however. The two borderlines need not necessarily be orthogonal. The angle between the two borderlines, i.e., the shape of the antenna area 52 may be designed depending on the shape of the substrate 50 and the antenna characteristics required. The same holds for the first conductor part 90 and the second conductor part 92. According to this modification, it is possible to improve the degree of freedom in antenna design. That is, only the low-profile grounded antenna has to be designed for proper function.

The embodiments have dealt with the case where the substrate 50 is mounted on the game controller 100. This is not restrictive, however. For example, the substrate 50 may be mounted on other communication apparatuses. According to this modification, it is possible to apply the substrate 50 to various types of apparatuses. In essence, only the substrate 50 has to be applied to an apparatus that performs wireless communications.

Figure 9:
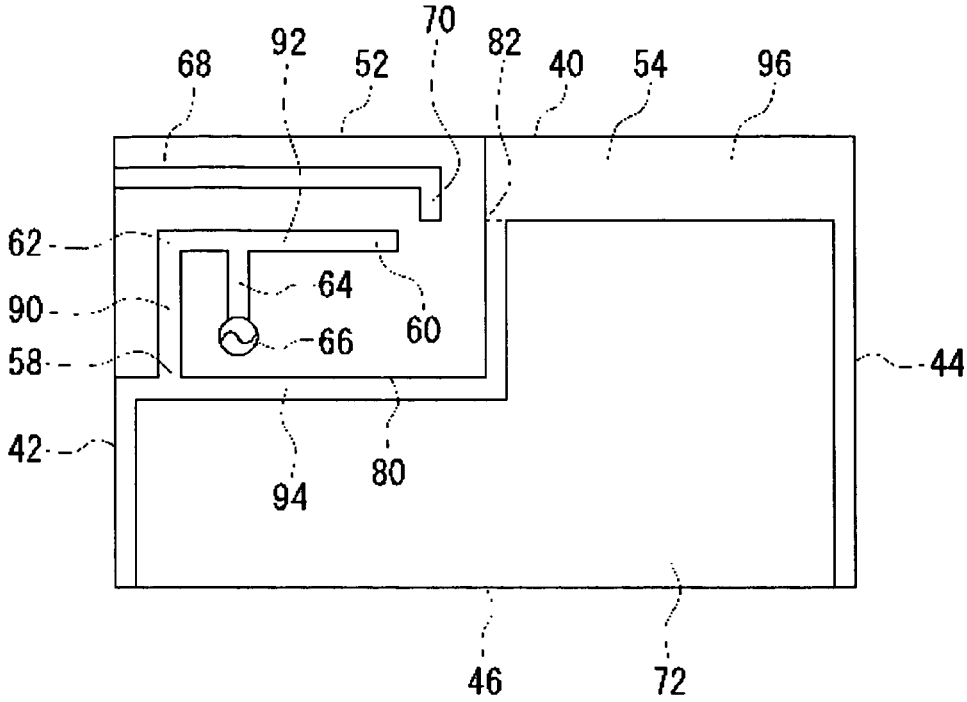
FIG. 9 is a diagram showing yet another configuration of the substrate of FIG. 8A.

The embodiments have dealt with the case where the component mounting area 72 is formed behind the second ground area 96 in FIG. 8A. This is not restrictive, however. For example, the substrate 50 may be configured as shown in FIG. 9. In FIG. 9, components having the same shapes and functions as those of the corresponding components in FIG. 8A will be designated by the same reference numerals as used in FIG. 8A. The second ground area 96 is formed to include the following: part of the front edge 40 which is not included in the antenna area 52; an area capable of mirroring a conductor that is positioned the closest to the front edge 40 out of the conductors formed in the antenna area 52, such as the director 68; and a strip of area extending along the right side edge 44. The first ground area 94 is formed to include a strip of area next to the antenna area 52, and a strip of area extending along part of the left side edge 42 which is not included in the antenna area 52. In this instance, the widths of the strip areas may be determined each depending on the antenna characteristics required. With the foregoing configuration, a component mounting area 72 is formed in the area other than the antenna area 52, the first ground area 94, and the second ground area 96. According to this modification, it is possible to increase the space to be occupied by the component mounting area 72.

Industrial Applicability

According to the present invention, it can lay out the antenna efficiently and ensure a desired antenna directivity as well.

The invention claimed is:

1. An antenna comprising:

an antenna area which is formed on a corner of a substrate;

an antenna conductor which is formed in the antenna area, has a first conductor part and a second conductor part, and is shaped so that the first conductor part and the second conductor part are connected to each other via a bend;

a first ground area which is formed next to the antenna area and is connected to an end of the first conductor part;

a second ground area which is formed next to the antenna area and is spaced away from an open end in a direction from the bend to the open end of the second conductor part;

a feed unit which feeds electricity to the antenna conductor; and a wave director which is formed in the antenna area and is positioned closer to an open front edge of the substrate than the second conductor part of the antenna conductor is, wherein the wave director is in an L shape and is bent at a position closer to the second ground area than the open end of the second conductor part of the antenna conductor, one part of the L shape is arranged opposite to the second conductor part of the antenna conductor, and another part of the L shape is arranged opposite to a border between the antenna area and the second ground area, wherein the second conductor part is designed to have a length approximately $\lambda/4$, and wherein an electric current is at a minimum at the open end of the second conductor part.

2. The antenna according to claim 1, wherein:

the antenna area is formed to include at least part of a side edge and part of a front edge of the substrate, the front edge and the side edge being open; and the antenna conductor is bent in an L shape, and the open end of the second conductor part is positioned closer to a center of the substrate than the bend is, when viewed from the side edge of the substrate.

3. The antenna according to claim 1, wherein the second ground area is formed in a position where it is possible to form a mirror image of at least the wave director.

4. The antenna according to claim 1, wherein the first ground area and the second ground area are formed as a continuous area on the substrate.

5. A wireless communication apparatus comprising an antenna and a communication unit which performs wireless communication through the antenna, wherein the antenna includes:

an antenna area which is formed on a corner of a substrate;

an antenna conductor which is formed in the antenna area, has a first conductor part and a second conductor part, and is shaped so that the first conductor part and the second conductor part are connected to each other via a bend;

a first ground area which is formed next to the antenna area and is connected to an end of the first conductor part;

a second ground area which is formed next to the antenna area and is spaced away from an open end in a direction from the bend to the open end of the second conductor part;

a feed unit which feeds electricity to the antenna conductor;

a wave director which is formed in the antenna area and is positioned closer to an open front edge of the substrate than the second conductor part of the antenna conductor is, wherein the wave director is in an L shape and is bent at a position closer to the second ground area than the open end of the second conductor part of the antenna conductor, one part of the L shape is arranged opposite to the second conductor part of the antenna conductor, and another part of the L shape is arranged opposite to a border between the antenna area and the second ground area, wherein the second conductor part is designed to have a length approximately λ/4, and wherein an electric current is at a minimum at the open end of the second conductor part.

6. The wireless communication apparatus according to claim 5, further comprising:

a component mounting area for a component having a predetermined function to be mounted in on the substrate, and wherein:

the antenna area is formed to include at least part of a side edge and part of a front edge of the substrate;

the second ground area is formed to include a portion of the front edge which is not included in the antenna area, an area capable of forming a mirror image of a conductor that is positioned the closest to the front edge out of conductors formed in the antenna area, and a strip of area extending along a side edge opposite from the side edge that is included in the antenna area;

the first ground area is formed to include a strip of area next to the antenna area, and a strip of area that is a portion of the side edge part of a side where the antenna conductor is formed and that is different from the antenna area; and the component mounting area is formed in an area other than the antenna area, the first ground area, and the second ground area.

7. A wireless communication apparatus comprising:

a grounded antenna, the grounded antenna including:

an antenna area which is formed on a corner of a substrate an antenna conductor which is formed in the antenna area, has a first conductor part and a second conductor part, and is shaped so that the first conductor part and the second conductor part are connected to each other via a bend;

a first ground area which is formed next to the antenna area and is connected to an end of the first conductor part;

a second ground area which is formed next to the antenna area and is spaced away from an open end in a direction from the bend to the open end of the second conductor part; and a feed unit which feeds electricity to the antenna conductor; a wave director which is formed in the antenna area and is positioned closer to an open front edge of the substrate than the second conductor part of the antenna conductor is, wherein the wave director is in an L shape and is bent at a position closer to the second ground area than the open end of the second conductor part of the antenna conductor, one part of the L shape is arranged opposite to the second conductor part of the antenna conductor, and another part of the L shape is arranged opposite to a border between the antenna area and the second ground area, wherein an electric current is at a minimum at the open end of the second conductor part.

8. The antenna according to claim 1, wherein a capacitor is formed by a part of the wave director opposite to the second ground area and by the second ground area.

9. The antenna according to claim 8, wherein a resonance frequency F0 of the antenna is given by:

$$F0=1/(2\pi\sqrt{(L1+L2)C})$$

where L1 is an inductance of the wave director, L2 is an inductance of a part corresponding to an image of the wave director in the second ground area, and C is a capacitance of the capacitor.

* * * * *